US005322203A

United States Patent [19]

Vickery

[11] Patent Number: 5,322,203

[45] Date of Patent: Jun. 21, 1994

[54] HOUSING UNIT FOR SECURING TAGGING GUN WITH ELECTRICAL OR PNEUMATIC ACTUATION MEANS

[76] Inventor: Leroy Vickery, 3404 Highway 73 N., Marianna, Fla. 32446

[21] Appl. No.: 47,647

[22] Filed: Apr. 13, 1993

[51] Int. Cl.[5] ..... B65C 7/00

[52] U.S. Cl. ..... 227/67; 227/130; 227/131

[58] Field of Search ..... 227/67, 68, 71, 76, 227/130, 131, 40, 48

[56] References Cited

U.S. PATENT DOCUMENTS 4,041,598 8/1977 D'Angelo ..... 29/432
4,235,161 11/1980 Kunreuther ..... 227/28
4,315,587 2/1982 Ritter et al. ..... 227/67
4,323,183 4/1982 Duchin ..... 227/67 X
4,589,583 5/1986 Kunreuther et al. ..... 227/67 X
4,627,562 12/1986 Bone ..... 227/67
4,718,590 1/1988 Engelhardt ..... 227/67
4,781,318 11/1988 Meyers ..... 227/67

*Primary Examiner*—Rinaldi I. Rada
*Attorney, Agent, or Firm*—Peter Loffler

[57] ABSTRACT

The present invention relates to a user friendly, inexpensive, portable space saving apparatus in which to house a conventional commercially available tagging gun and actuation means for automation of the tagging operation. The instant invention will significantly reduce operator fatigue and substantially increase plant safety and productivity. In particular, one embodiment is disclosed for electrical operation and a second embodiment is disclosed for pneumatic operation.

13 Claims, 3 Drawing Sheets

HOUSING UNIT FOR SECURING TAGGING GUN WITH ELECTRICAL OR PNEUMATIC ACTUATION MEANS

BACKGROUND OF THE INVENTION

This invention relates to a housing apparatus to house a tagging gun which affixes tags to garments by means of tag fasteners of the "bar lock" or similar type.

Clothing manufactures generally have a need to affix tags to clothing. The tags contain such information as size, price, style, color, inventory control numbers and other such similar information. The tags are affixed to the garments by the use of a tag fastener with the fastener being dispensed into the garment by some form of tagging apparatus.

Two common apparatus are available for use in dispensing the tag fastener into the garment. The first and more basic method is by the use of a common hand-held tagging gun. The tagging gun is readily available, inexpensive to obtain and is simple and straight-forward to operate. Despite these benefits, the tagging gun suffers many drawbacks. In order to operate the gun the operator must place the gun in one hand and the garment in the other, then position the gun to the appropriate place on the garment and squeeze the trigger of the tagging gun. As one hand is continually occupied by the tagging gun, the operator has but one free hand with which to manipulate the garment. This proves to be an inefficient method of tagging. Whenever the tagging gun is lifted up the possibility exists that the operator retrieves the gun by the needle end thereby causing injury. Whenever the tagging gun is placed back upon the work station the possibility exists that it is placed down on the needle end or dropped thereby causing damage to the gun. Through constant holding and squeezing of the tagging gun trigger, operator fatigue quickly sets in.

In order to alleviate the problems associated with hand-held tagging guns, automated tagging apparatus have been proposed. Illustrative of the previously proposed automated apparatus is that disclosed in U.S. Pat. No. 4,781,318, issued Nov. 1, 1988 to Meyers. Such apparatus provide means for securing the fastener dispensing device in a fixed position and for effecting the automatic operation of the apparatus by means of actuating a readily accessible switch. This type of apparatus enhances productivity by freeing both hands of the operator and eliminating the necessity of the operator having to hold and squeeze the tagging gun trigger. This type of apparatus eliminates the possibility of an operator grabbing a needle and also eliminates damage to the tagging dispenser by eliminating the possibility of dropping the dispenser or placing it down on the needle end.

While these types of apparatus can greatly increase the speed, safety and efficiency of the tagging process, they suffer from several shortcomings. Due to the complexity of the apparatus, these machines are difficult to manufacture and assemble. As this type of apparatus uses a proprietary tag dispensing unit, added expense is realized in manufacturing and maintaining the device. With many moving parts, repairs can be frequent and costly. This situation can be aggravated if the broken part needs to be ordered from the manufacturer and the tag dispensing unit is nonfunctional until arrival of the replacement part. A final disadvantage is that this type of apparatus must be modified each time a fastener of a different size is necessary.

The present invention overcomes the shortcomings of both types of methods previously proposed. The present invention securely houses a readily available tagging gun in a secure and stationary position, thereby freeing both hands of the operator and also eliminating the necessity of the operator holding and squeezing the tagging gun trigger, and also eliminating the possibility of either grabbing the tagging gun needle or dropping the gun onto the floor. The present invention consists of a simple design utilizing a minimal number of moving parts. This will substantially reduce manufacture and assembly costs of the invention. As the invention utilizes a minimal number of moving parts, all constructed of common materials, both machine down-time and repair costs will be reduced. Should the invention malfunction, the tagging gun can be used manually, if necessary, during the pendency of the repairs. As the invention accepts a readily available commercial tagging gun, the costs associated with proprietary tagging fasteners is eliminated, as is the need to modify the tagging gun to accept fasteners of a different type.

Prior techniques do not suggest the present inventive combination of component elements as disclosed and claimed herein. The present invention achieves its intended purposes, objectives and advantages over the prior devices through a new, useful and non-obvious combination of component elements, which is simple to use, with the utilization of a minimum number of functioning parts, at a reasonable cost to manufacture, assemble, test and by employing only readily available material.

Therefore, it is an object of the present invention to provide an inexpensive, portable, and user-friendly housing apparatus for securely housing any conventional readily available tagging gun which readily accepts fasteners of any size, and means for automatic hands free operation of the tagging gun.

Another object of the invention is that the apparatus be of simple design, being constructed of inexpensive and common and readily available parts and have a minimal number of internal moving parts.

A final object of this invention to be specifically enumerated herein is to provide a housing apparatus and method for a conventional tagging gun in accordance with the proceeding objects and which will conform to conventional forms of manufacture, be of simple construction and easy to use so as to provide a device that would be economically feasible, long lasting and relatively trouble free in operation.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

DESCRIPTION OF THE PRIOR ART

U.S. Pat. No. 4,781,318 issued on Nov. 1, 1988, to Meyers discloses a tagging apparatus comprising at least one support unit and at least one tag supplying unit. The tag supplying unit includes a tag hopper and a tag conveyor and is mounted for multidirectional adjustive movement upon the support unit and relative to the needle of a fastener dispenser mounted at a fixed location upon the support unit.

U.S. Pat. No. 4,235,161 issued on Nov. 25, 1980, to Kunreuther and Beringhaus discloses a means for mounting a tagging apparatus fastener dispensing device in a fixed position. The means for effecting automatic operation of the device in response to operator actuation of a readily accessible switch. The invention includes means for conducting tags from a supply hopper or the like to and onto the hollow needle of the dispensing device.

U.S. Pat. No. 4,041,598 issued on Aug. 16, 1977, to D'Angelo discloses a pneumatically operated stapling apparatus and method for driving a staple into the work piece whenever the work piece is moved into a stapling position between a staple driver and a backing member. The pneumatic control means in the stapling apparatus and method comprises a pneumatic reservoir, a pneumatic actuator coupled to the stapler control valve to control the positioning thereof, and a valve connected to the trigger element.

None of these previous efforts, however, provide the benefits intended with the present invention. These major benefits of the present invention over the prior art include an apparatus that is simple and inexpensive to construct. An apparatus that will accommodate any commercially available tagging gun. Another benefit is that the invention is lightweight and can easily be relocated within the plant by a single operator. Additionally, prior techniques do not suggest the present inventive combination of component elements as disclosed and claimed herein. The present invention achieves its intended purposes, objectives and advantages over the prior devices through a new, useful and non-obvious combination of elements, which is simple to use, with the utilization of a minimum number of functioning parts, at a reasonable cost to manufacture, assemble, test and by employing only readily available material.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

SUMMARY OF THE INVENTION

Figure 1:
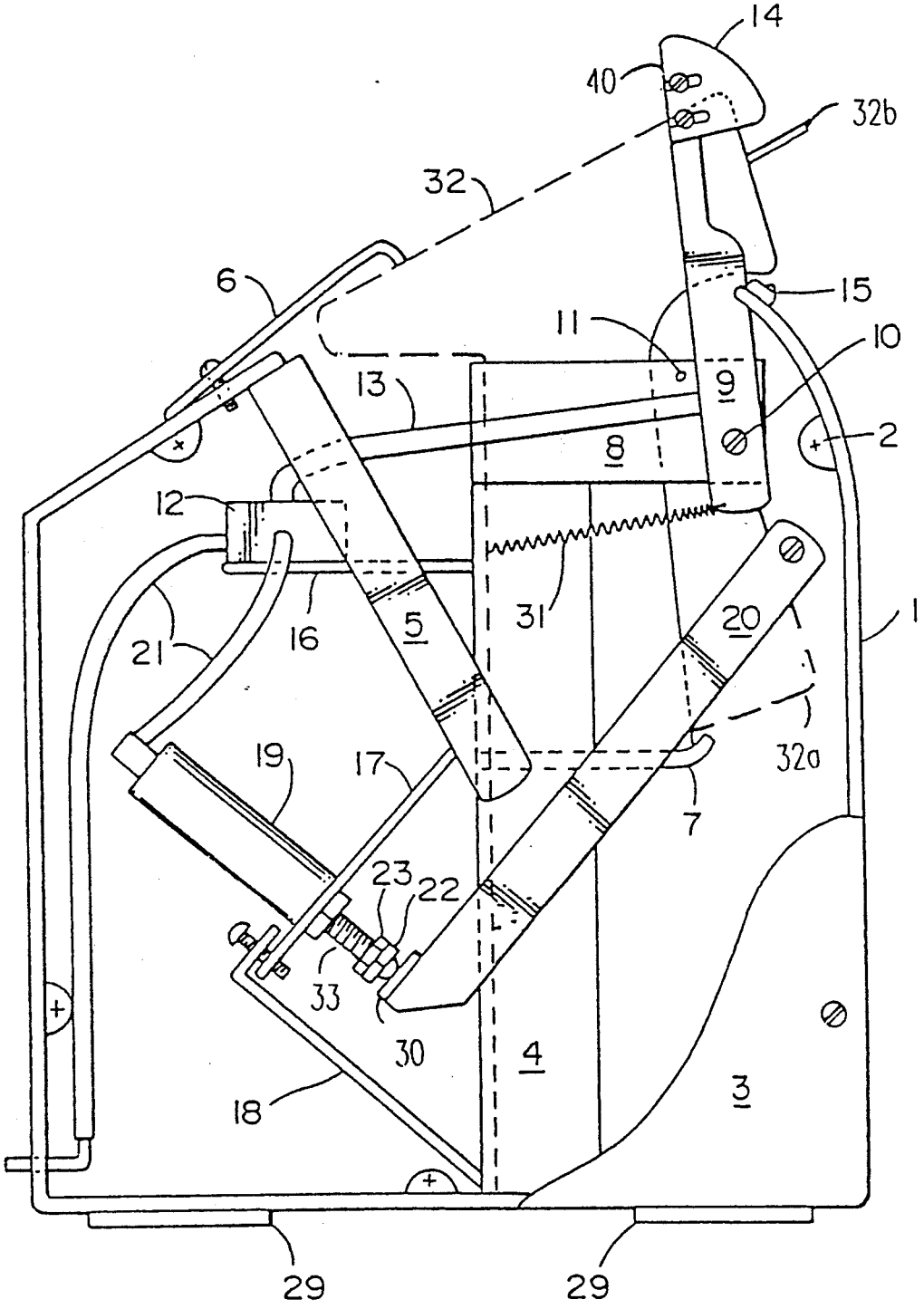
FIG. 1 is an elevational cross section view of the pneumatic embodiment of the invention.

In a preferred embodiment of the invention to be described hereinbelow in detail the housing unit is set up in such a way so that a tag fastener is inserted into a piece of clothing by a tagger whenever a work piece is placed in a tagging position against the tagging gun needle. The tagger is supplied by a tagging gun of a known type having a tagging mechanism controlled by a trigger mechanism on the front side of the tagging gun activated by depressing the trigger. The housing unit has an actuation mechanism positioned to be depressed as a clothing work piece is placed into tagging position against a contact plate. The contact plate pivots a switch arm. The switch arm has contact means for activating a compressed air supply from outside the housing unit, said air supply providing air to an air cylinder and thereby completing a pneumatic circuit. The air cylinder has a pneumatic piston which extends outwardly upon the completion of the pneumatic circuit, to make contact with a pivot arm causing the lower end of the pivot arm to arc forward, and the upper end of said pivot arm arcing backward, with the backward arcing motion causing said upper end of the pivot arm to depress the tagging gun trigger by contact means, thereby tagging the clothing work piece.

Upon removal of the tagged clothing work piece, a spring means retracts the actuator switch arm causing the contact means to deactivate the compressed air supply and thereby open the pneumatic circuit. The loss of the pneumatic circuit causes the pneumatic piston to retract inwardly thereby releasing pressure on the lower end of the pivot arm. The recocking of the tagging gun trigger pushes the pivot arm into its original ready position.

In another embodiment of the invention the switch arm has contact means for depressing an electric switch thereby completing an electric circuit, the electric circuit being wired to an electromagnetic solenoid. The solenoid has a solenoid piston which extends outwardly upon the completion of the electric circuit, to make contact with a pivot arm causing the lower end of the pivot arm to arc forward, and the upper end of the pivot arm arcing backward, with the backward arcing motion causing said upper end of the pivot arm to depress the tagging gun trigger by contact means thereby tagging the clothing work piece.

Upon removal of the tagged clothing work piece, a spring means retracts the actuator switch arm causing the contact means to deactivate the electric switch and thereby open the electric circuit. The loss of the electric circuit causes the solenoid piston to retract inwardly thereby releasing pressure on the lower end of the pivot arm. The recocking of the tagging gun trigger will push the pivot arm into its original ready position.

In a more detailed aspect of this invention, the tagging gun is housed within the housing unit and sits on a rest plate. The tagging gun being held in place by clamping means to eliminate operational vibration.

In another detailed aspect of this invention said contact plate is adjustable both vertically and horizontally to permit use of clothing work pieces of any thickness and maximizing operator comfort and convenience.

Other objects, aspects, and advantages will be pointed out in, or apparent from, the detailed description hereinbelow, considered together with the preceding drawings.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

DESCRIPTION OF THE PREFERRED EMBODIMENTS

FIG. 1 illustrates a tagging gun housing unit in accordance with the present invention arranged to insert a tag fastener into a work piece.

Figure 3:
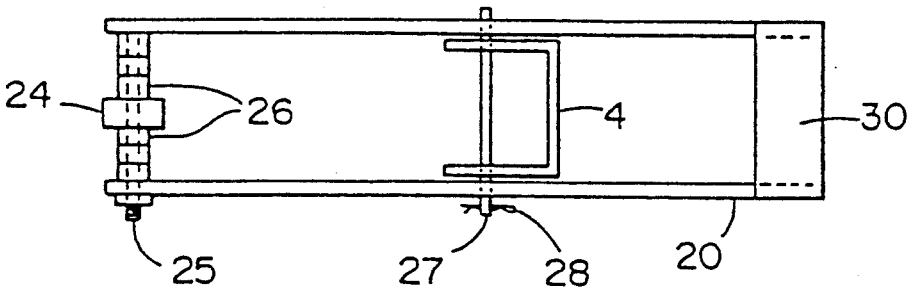
FIG. 3 is a top view of the pivot arm of the pneumatic embodiment and the electromagnetic embodiment of the invention.
Figure 2:
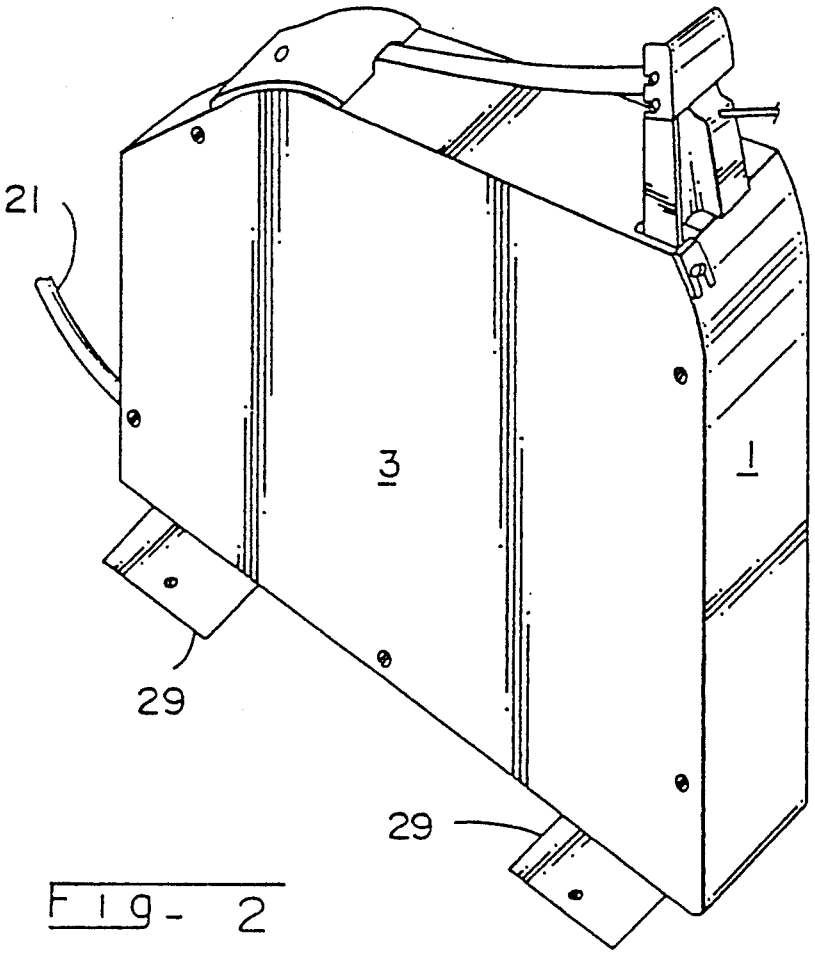
FIG. 2 is a perspective view of the pneumatic embodiment and the electromagnetic embodiment of the invention.

As illustrated by FIGS. 1-3 the housing unit consists of an external frame 1 with side panels 3 attached to the external frame 1 by anchor nuts 2. The external frame 1 four flat anchor plates 29 at its base, one at each corner, extending outwardly from the base. Each plate 29 has one hole in the center to permit the entire base to be threadably attached to the work surface by bolt means. The top front of the housing unit contains an opening permitting the needle-bearing part of the tagging gun 32 (shown in outline) to be exposed.

The tagging gun 32 is positioned so that the tag magazine acceptor, which accepts the magazines of tag fasteners into the tagging gun, is located outside of the housing unit, thereby permitting fastener magazines to accommodate tags of any length to be attached to the tagging gun.

The tagging gun 32 is also positioned so that the tag fastener residue, which is left over after a tagging cycle, is discharged away from the internal components of the housing unit.

As FIGS. 1-3 illustrates, the inside of the housing unit contains a main frame 4. The main frame is supported by a diagonal brace 5. Attached to the main frame 4 and extending outwardly is a rest plate 7 and a support arm bracket 8. Positioned on the rest plate 7 is a tagging gun 32 of a known commercially available type. The tagging gun 32 is secured to the frame by means of an arched spring-loaded hold down clip means 6.

Attached to the base of the main frame 4 and extending diagonally outward and to the rear is a retention bracket 18. Weldably attached to the midpoint of the main frame 4 and extending diagonally downward and to the rear is an air cylinder bracket 17. The air cylinder bracket 17 is boltably attached to the retention bracket 18. Attached to and supported by the air cylinder bracket 17 is an air cylinder 19. The air cylinder has a pneumatic piston 33 which extends outwardly upon the completion of a pneumatic circuit to the air cylinder 19 and retracts inwardly upon the loss of a pneumatic circuit. Attached to the main frame 4 and extending outwardly is a switch support bracket 16. An air activate switch 12 is attached to and supported by the switch support bracket 16. The air cylinder 19 is connected to the air outlet nozzle of the air activate switch 12 by an air conduit 21. The air intake nozzle of the air activate switch 12 is connected to a compressed air supply (not shown) by an air conduit 21.

Pivotally attached to the housing unit and support arm bracket 8 by a shoulder bolt 10 is a switch arm 9. The bottom of the switch arm 9 is connected by a switch arm foot 13 to the air activate switch 12. Connected to the top of the pivot arm 9 is a contact plate 14. The contact plate 14 is adjustable both vertically and horizontally by plate mounting screws 40.

A pivot arm 20 is pivotally attached to the main frame 4 of the housing unit by a pivot pin 27, (illustrated in FIG. 3) which pivot pin is secured by a cotter key 28. A roller bearing 24 is attached at the top end of the pivot arm by means of a bearing bolt 25 and kept in alignment by shims 26. The roller bearing 24 comes in contact with and rests up against the said tag gun trigger 32*a*.

A clothing work piece is placed into tagging position against the tag gun needle 32*b*. The tag gun 32 is actuated by depressing the contact plate 14 with the clothing work piece. The contact plate 14 triggers the switch arm 9 causing said switch arm to pivot until making contact with a stop pin 11. The pivoting action of the switch arm 9 causes the lower end of the arm to pull on the switch arm foot 13. The switch arm foot triggers the air activate switch 12, causing the air cylinder 19 to intake air. The air so taken in completes a pneumatic circuit causing the pneumatic piston 33 to extend outwardly t and depressing the pressure plate 30 of the lower arm of the pivot arm 20, causing the lower arm to arc toward the front of the actuator housing. As the lower arm arcs left, the upper arm arcs right causing the roller bearing 24 to press up against the tagging gun trigger 32*a* causing the trigger 32*a* to be depressed, thereby discharging a tag fastener into the clothing work piece. Appropriate distance between the pneumatic piston 33 and the pressure plate 30 is maintained by a cap nut 22 and lock nut 23.

Upon the work piece being tagged, it is removed from the contact plate 14. The switch arm 9 returns to its original position against a return stop 15 by spring means 31. The returning switch arm 9 releases the switch arm foot 13 which in turn releases the air activate switch 12 thereby opening the pneumatic circuit. The loss of the pneumatic circuit causes the pneumatic piston 33 to retract inwardly. The loss of contact upon the pressure plate 30 of the lower end of the pivot arm 20 by the pneumatic piston causes a loss of pressure on the lower end of the pivot arm 20. Due to the loss of pressure, the pivot arm 20 returns to its original position due to the recocking of the tagging gun trigger 32*a*, whereby the trigger extends outwardly, placing pressure on the upper end of the pivot arm 20 thereby causing it to return to its original position.

Figure 4:
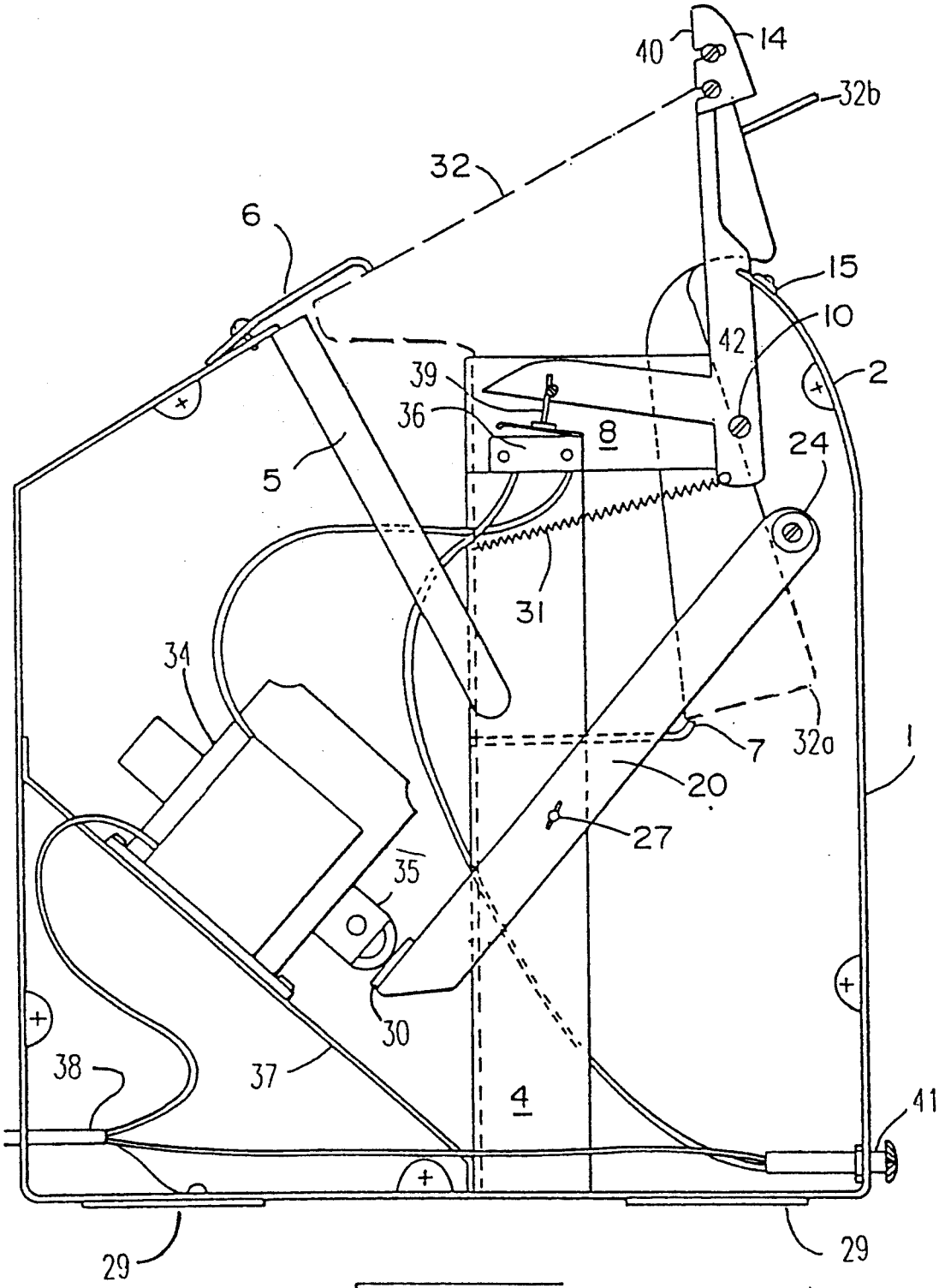
FIG. 4 is an elevational cross section view of the electromagnetic embodiment of the invention.

FIG. 4 illustrates another embodiment of the invention. This embodiment contains an electromagnetic bracket 37 attached to the base of the main frame 4 and extending diagonally upward toward the rear and is attached to the rear wall of the external frame 1. Attached to and supported by the electromagnetic bracket 37 is an electromagnetic solenoid 34. The electromagnetic solenoid 34 has a solenoid piston 35 which extends outwardly upon the completion of an electric circuit to the electromagnetic solenoid 34 and retracts inwardly upon the loss of an electric circuit. Power to the electromagnetic solenoid 34 is supplied by an outside power source (not shown) by appropriate wiring 38.

The electromagnetic solenoid 34 is connected by wire 38 to an electric switch 36. The electric switch 36 is wired to the outside power source through a fuse 41.

Actuation of the tagging gun in this embodiment is accomplished by depressing the contact plate 14. The contact plate 14 triggers the switch arm 42 causing said switch arm to pivot until the switch arm foot 39 depresses the electric switch 36. The depression of the electric switch 36 completes an electric circuit causing the solenoid piston 35 to extend outwardly to make contact with the pressure plate 30 of the pivot arm 20.

The pivot arm 20 triggers the tagging gun 32 in the conventional way as previously described for the pneumatic embodiment. Upon removal of the work piece from the contact plate 14, the switch arm returns to its original position against the return stop 15 by spring means 31. The returning switch arm 42 releases the switch arm foot 39 which in turn releases pressure on the electric switch 36 thereby opening the electric circuit. The opening of the electric circuit causes the solenoid piston 35 to retract inwardly causing a loss of pressure on the pressure plate 30 of the lower arm of the pivot arm 20. The remainder of the actuator mechanism resets itself in the conventional way as described previously for the pneumatic embodiment.

Although specific embodiments of the invention have been disclosed herein in detail, it is understood that this is for purpose of illustrating the invention and should not be construed as necessary limiting the scope of the invention since it is apparent that many changes can be made to the disclosed structure by those skilled in the art to suit particular applications.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

I claim:

1. A tagging device comprising:

a tagging gun;

said tagging gun includes a top portion, a middle portion and a bottom portion;

said tagging gun includes a needle and a trigger;

said needle is located at said top portion of said tagging gun and said trigger is located at said middle portion of said gun;

a supporting means for supporting said tagging gun;

said supporting means includes a channel forming a main frame;

said channel includes a rest plate to support and align said tagging gun;

said rest plate extends outwardly and perpendicularly from said channel;

said channel has a top end and a bottom end;

said rest plate supports said bottom portion of said tagging gun;

a trigger pulling assembly for activating and depressing said trigger of said tagging gun;

said trigger pulling assembly includes a first contact plate, a switch arm, a switch arm foot, a trigger pulling means and an actuation means for activating said trigger pulling means;

said switch arm has a first end and a second end;

said first end of said switch arm is attached to said first contact plate and said second end of said switch arm is pivotally attached to said top end of said channel;

said first contact plate is attached at said first end of said switch arm and above and vertically aligned with said needle of said tagging gun;

said switch arm foot is attached to said second end of said switch arm and comes in contact with said actuation means and wherein said first contact plate initiates said trigger pulling assembly by pivoting said switch arm and said switch arm activates said switch arm foot which activates said actuation means which triggers said trigger pulling means;

a housing;

said housing consist of a base, a first wall, a second wall, a third wall, a fourth wall and a fifth wall;

said first wall is parallel to said second wall;

said first wall is identical in design, structure and size to said second wall;

said third wall is parallel to said fourth wall;

said base is parallel to said fifth wall;

said first wall is in direct communication with said third wall, said fourth wall, said fifth wall and said base;

said second wall is in direct communication with said third wall, said fourth wall, said fifth wall, and said base;

said base, said third wall, said fourth wall, and said fifth wall form an external frame;

said base has a top surface and a bottom surface;

said top surface faces said fifth wall;

said channel of said supporting means is attached to said top surface of said base;

an opening is provided in said housing;

said opening is located in said fifth wall;

said opening receives said middle portion and said bottom portion of said tagging gun;

said base, said first wall, said second wall, said third wall, said fourth wall and said fifth wall surround and cover said middle portion and said bottom portion of said tagging gun, said support means, said second end of said switch arm, said switch arm foot, said actuation means, and said trigger pulling means, and wherein said first end of said switch arm and said top portion of said tagging gun are located outside said housing;

a clip secures said tagging gun to said housing said clip has a front portion and a back portion said front portion of said clip is affixed to said top portion of said tagging gun; and said back portion of said clip is affixed to said fifth wall of said housing.

2. A tagging device as in claim 1 wherein said actuation means is a pneumatic controlled system.

3. A tagging device as in claim 2 wherein pneumatic controlled system consists of an air activated switch, an air cylinder, and a pneumatic piston;

said air activated switch is connected to said air cylinder by a connecting means;

said air cylinder is connected to said pneumatic piston;

said pneumatic piston extends outwardly when activated; and wherein said switch arm foot triggers said air activated switch which initiates said air cylinder to activate said pneumatic piston, and said pneumatic piston extends outwardly, communicates with and activates said trigger pulling means.

4. A tagging device as in claim 3 wherein said connecting means is a first air conduit and said air activate switch is connected to a compressed air supply by a second air conduit.

5. A tagging device as in claim 3 wherein said trigger pulling means consist of a pivot arm;

said pivot arm has a first end area, a middle area and a second end area;

a second contact plate is located on said second end area of said pivot arm;

said pneumatic piston extends outwardly to activate said trigger pulling means at said second contact plate;

said middle area of said pivot arm is pivotally attached to said channel;

a roller bearing is affixed to said first end area of said pivot arm by an attachment means; and said roller bearing comes in contact with said trigger of said tagging gun when said pivot arm is activated.

6. A tagging device as in claim 5 wherein said attachment means includes a bearing bolt.

7. A tagging device as in claim 5 wherein said support plate for said air activate switch is secured to said channel and a bracket supports and secures said pneumatic piston to said channel.

8. A tagging device as in claim 1 wherein said actuation means is a electromagnetic controlled system.

9. A tagging device as in claim 8 wherein said electromagnetic controlled system includes an electromagnetic solenoid, an electric switch and a solenoid piston;

said electric switch is electrically connected to said electromagnetic solenoid and said electromagnetic solenoid is connected to said solenoid piston; and wherein initiating said first contact plate triggers said switch arm causing said switch arm to pivot and depresses said electric switch, said electric switch activates said electromagnetic solenoid, and said electromagnetic solenoid activates the solenoid piston to extend outwardly to activate said trigger pulling means.

10. A tagging device as in claim 9 wherein said trigger pulling means consist of a first pivot arm;

said first pivot arm has a first end portion, a center portion, and a second end portion;

a second contact plate is located on said second end portion of said first pivot arm;

said solenoid piston extends outwardly to activate said trigger pulling means at said second contact plate;

said center portion of said first pivot arm is pivotally attached to said channel; and a roller bearing is affixed to said first end portion of said first pivot arm by an attachment means and said roller bearing comes in contact with said trigger of said tagging gun when said first pivot arm is activated.

11. A tagging device as in claim 10 wherein said attachment means includes a bearing bolt.

12. A tagging device as in claim 10 wherein a support bracket secures said electromagnetic solenoid and said support bracket is attached to said channel.

13. A tagging device as in claim 1 wherein said base has a first corner, a second corner, a third corner and a fourth corner;

a first flat anchor plate is secured to said bottom surface of said base at said first corner and to said second corner;

said first flat anchor plate has a first end portion and a second end portion;

said first end portion of said first flat anchor plate extends outwardly from said first corner of said base;

said second end portion of said first flat anchor plate extends outwardly from said second corner of said base;

a second flat anchor plate is secured to said bottom surface of said base at said third and across to said fourth corner;

said second flat anchor plate has a first portion and a second portion;

said first portion of said second flat anchor plate extends outwardly from said third corner of said base;

said second portion of said second flat anchor plate extends outwardly from said fourth corner of said base.

* * * * *